US008519681B2

(12) United States Patent
Mathewson

(10) Patent No.: US 8,519,681 B2
(45) Date of Patent: Aug. 27, 2013

(54) APPARATUS AND METHOD FOR GENERATING A METERING VOLTAGE OUTPUT FOR A VOLTAGE REGULATOR USING A MICROPROCESSOR

(75) Inventor: Joel C. Mathewson, Pearl, MS (US)

(73) Assignee: Siemens Energy, Inc., Orlando, FL (US)

( * ) Notice: Subject to any disclaimer, the term of this patent is extended or adjusted under 35 U.S.C. 154(b) by 436 days.

(21) Appl. No.: 13/025,418

(22) Filed: Feb. 11, 2011

(65) Prior Publication Data

US 2012/0206115 A1 Aug. 16, 2012

(51) Int. Cl.
*G05F 1/153* (2006.01)

(52) U.S. Cl.
USPC ..... 323/257; 323/341; 323/342

(58) Field of Classification Search
USPC ..... 323/255–258, 301, 340–343
See application file for complete search history.

(56) References Cited

U.S. PATENT DOCUMENTS

| | | | | |
|---|---|---|---|---|
| 4,041,288 | A | 8/1977 | Conway | |
| 4,538,100 | A | 8/1985 | Tuten | |
| 4,799,041 | A | 1/1989 | Layton | |
| 5,521,959 | A | 5/1996 | Walsworth | |
| 5,550,459 | A | 8/1996 | Laplace | |
| 5,642,290 | A * | 6/1997 | Reilly et al. | 700/298 |
| 6,025,753 | A | 2/2000 | Landherr | |
| 6,694,272 | B1 | 2/2004 | Zvonar | |
| 7,023,193 | B2 | 4/2006 | Champion | |
| 7,474,082 | B2 | 1/2009 | Huang | |
| 7,505,600 | B2 | 3/2009 | Dryer | |
| 8,427,131 | B2 * | 4/2013 | Bryson et al. | 323/343 |
| 2005/0068013 | A1 * | 3/2005 | Scoggins | 323/258 |
| 2005/0104567 | A1 | 5/2005 | Beckwith | |
| 2010/0045246 | A1 * | 2/2010 | Bryant et al. | 323/255 |
| 2012/0206115 | A1 * | 8/2012 | Mathewson | 323/257 |

FOREIGN PATENT DOCUMENTS

| | | | |
|---|---|---|---|
| GB | 2109960 | A | 6/1983 |
| WO | 2004114041 | A1 | 12/2004 |

* cited by examiner

*Primary Examiner* — Jeffrey Sterrett

(57) ABSTRACT

A voltage regulator (10) for regulating a power distribution system voltage during forward or reverse power flow. The voltage regulator (10) accommodates multiple configurations of a tertiary winding (30) and a potential transformer (36) connected across source-side bushings (S/SL) or load-side bushings (L/SL). The invention simulates operation of a potential transformer (36), and the output voltage therefrom, connected across the source-side (S/SL) or load-side bushings (L/SL). The invention also produces a corrected voltage compensating a non-standard turns ratio of the tertiary winding (30). The regulator (10) controls a tap changer (18) to regulate the system voltage according to a digital value representing the voltage across the source-side (S/SL) or load-side bushings (L/SL), comprising a measured voltage, the corrected voltage or the simulated voltage. The digital value is converted to an analog voltage and supplied to external terminals (102) for measuring by a service technician using a voltmeter (104).

26 Claims, 4 Drawing Sheets

APPARATUS AND METHOD FOR GENERATING A METERING VOLTAGE OUTPUT FOR A VOLTAGE REGULATOR USING A MICROPROCESSOR

FIELD OF THE INVENTION

The present invention relates to voltage regulators and, more particularly, to the use of a microprocessor to simulate an output voltage, nominally an output voltage that is based on a common distribution transformer ratio and available for measuring at external test terminals.

BACKGROUND OF THE INVENTION

A voltage regulator is a power quality device that provides a stable output voltage despite fluctuations in an input voltage. Voltage regulators are typically located at distribution substations and on single power line feeders. For example, if an input voltage fluctuates between 110 VAC and 130 VAC, the voltage regulator maintains the output voltage at a constant 120 VAC. The voltage regulator operates by comparing the actual output voltage (which is either measured directly or calculated as described below) to a fixed reference voltage set point (a user-defined setting). The reference voltage setpoint is typically stored within a regulator control panel, which controls operation of the regulator. The regulator control panel determines the difference between the actual output voltage and the reference voltage set point and uses this difference to control a regulating element. Generally, a voltage regulator control panel comprises electronic components with input and output signals and attendant software programs to control regulator operation.

One example of a regulating element is a tap changer that establishes the winding ratio between a primary and a secondary transformer winding. A motor controls a position of the tap changer; operating the tap changer changes the winding ratio and thus the transformer secondary winding output voltage. The voltage regulator control panel controls the position of the tap changer to reduce the difference between the regulator output voltage and the set point to a value within a user-defined bandwidth, typically between about 1 and 6 volts.

Voltage regulators are sized for operation on distribution systems with nominal voltages between about 2400 VAC and 34,500 VAC. By controlling the tap position of the tap changer the distribution voltage can be varied by about ±10%.

One voltage regulator used in the electrical power industry increases or decreases its output voltage by up to 10% of its input voltage in ⅝% steps. Adjusting the transformer tap changer to one of thirty-two tap changer positions, each position providing a ⅝% adjustment, produces the total adjustment range of about ±10%. Typically, a tap changer comprises eight different available connections (i.e., eight different voltages) to a series winding. A preventive autotransformer (also known as a bridging reactor) permits operation in either a bridging or a non bridging mode. In the bridging mode, two movable tap changer contacts are connected to two different voltages (e.g. to two different stationary contacts) on a series winding, effectively providing a voltage that is halfway between the voltages at the two contacts. Operation in the bridging mode allows the tap changer to operate without causing voltage interruptions in the output voltage. Finally, a reversing switch (having positions K and M as illustrated in the figures herein) changes the winding polarity and further doubles the available tap positions. Thus a total of thirty-two tap positions are available, sixteen positions raise the regulator output voltage and sixteen positions lower the voltage.

During periods of peak demand the voltage on an electrical power distribution system can drop, especially if the system uses relatively small-diameter conductors. As additional current is demanded, the relatively high resistance of the small-diameter conductors increases the voltage drop through the conductors, thus lowering the system voltage. The voltage regulator can compensate this voltage drop by monitoring the distribution system voltage and knowing the fixed reference voltage set point (i.e., the desired output voltage), operate the tap changer to increase the output voltage supplied to the distribution system.

Fluctuations (up or down) in a source or input voltage to the voltage regulator can also be compensated by operating the tap changer to supply an output voltage at the reference voltage. Thus the voltage regulator maintains a stable output (load) voltage despite changes in the load demand (current) or changes in the source voltage.

The use of voltage regulators is also mandated by the increasing number of interconnects between power system regions and the use of different system voltages by power system operators.

With the increasing complexity of power system interconnects and the use of automatic power restoration devices, current (power) may flow in a forward or a reverse direction through an electrical power distribution system. Obviously, reverse current (power) flow also causes power flow in the reverse direction through the voltage regulator. Thus the voltage regulator must be capable of operating under both forward and reverse power flow conditions.

There are two common types of voltage regulators, referred to as Type A and Type B regulators. Each regulator type may also include a potential transformer. With both forward and reverse power flow controlled by the Type A and B regulators (with and without a potential transformer) there are therefore eight different possible scenarios.

The references to the voltage regulator "source bushing side" (the S and SL bushings or terminals) and the voltage regulator "load bushing side" (the L and SL bushings or terminals) in the discussion below of the Type A and B regulators refer to the regulator bushings or terminals and do not refer to the direction of current (power) flow. For forward power flow, power is supplied to the S and SL terminals and the output side comprises the L and SL terminals. For reverse power flow, power is supplied to the L and SL terminals and the load is connected across the S and SL terminals. Thus the "source side" and the "load side" are reversed when the power flow direction reverses.

An ANSI Type A voltage regulator 10 illustrated in FIG. 1 includes S and SL bushings or terminals with an exciting winding 12 disposed between the S and SL bushings. A series winding 14 forms an autotransformer with the exciting winding 12; the voltage taps are disposed on the series winding 14. The voltage regulator 10 further comprises L and SL bushings or terminals. Forward power flow direction in FIG. 1 is indicated by an arrowhead 15, i.e., forward power flow from the S/SL terminals to the L/SL terminals.

An output voltage of the regulator 10 at the terminals L/SL (for forward power flow) is controlled by a position of a tap changer 18 on the series winding 14 through bridging and non-bridging connections to the stationary contacts 0-8 connected to the series winding 14. The tap changer 18 comprises stationary contacts 19 and moving contacts 22. The moving contacts 22 are connected to a preventive autotransformer 24 (which, among other features, allows tap changer operation without power interruption). The autotransformer 24, which supplies the output voltage from the regulator 10, is connected to the L terminal or bushing through a conductor 25.

A switch 28 connected to the S terminal or bushing comprises a switch wiper 28A connected to the exciting winding 12. The switch 28 can be closed through terminal M or terminal K of the series winding 14 to change the polarity of the voltage through the winding 14. This polarity selection, together with the available tap positions, provides an output voltage adjustment through a range of about −10% to about +10% of the input voltage to the voltage regulator.

A tertiary (utility) winding 30, responsive to magnetic flux generated by the exciting winding 12, supplies power to a voltage regulator controller that in turn controls a tap changer motor (neither illustrated in FIG. 1) to operate the tap changer 18 to a desired tap position. The tertiary winding 30 also supplies power to other components of the voltage regulator 10, including the control panel.

The voltage regulator 10 further comprises a current transformer (CT) 34 and a potential transformer (PT) 36, both on the L/SL bushing side of the voltage regulator 10. The CT 34 produces a current that is a fraction of the load current flowing from the autotransformer 24 to the load through the L terminal. The CT current is used for instrumentation purposes.

The PT 36 generates a voltage that is a fraction of the load voltage across the L/SL terminals. The PT 36 comprises a primary winding 36A connected across the L and SL terminals and a secondary winding 36B that generates a voltage responsive to the primary winding voltage. The ratio of the primary to the secondary voltage is determined by the turns ratio between the primary and secondary windings. The PT has a conventional or standard turns ratio between the primary and secondary winding, such as a ratio of 60:1.

In operation during forward power flow in the direction indicated by the arrowhead 15, the regulator measures the voltage (the load-side voltage) across the PT secondary winding 36B and determines a difference between the PT secondary winding voltage and a reference set point or desired voltage. The regulator controller then controls the tap changer motor to operate the tap changer 18 to reduce this difference to about zero. By controlling the tap changer 18 to control the PT secondary winding voltage to a desired value, the output of the regulator across the L and SL terminals (the load side in this configuration) is thereby controlled to a desired value.

Consider operation of the regulator 10 during reverse power flow as indicated by an arrowhead 39. The PT 36 is positioned across the L and SL terminals, but for reverse power flow the L and SL bushings are on the source side of the regulator. The output or load voltage is between the S/SL terminals. In this scenario, the voltage across the tertiary winding 30 (now on the load side) is measured and the tap changer controller controls the tap changer motor to operate the tap changer and attain the desired output or load voltage across the tertiary winding or the S/SL terminals.

It is known that a typical tertiary winding 30 has a non-standard turns ratio (for example, not a 60:1 or a 63.5:1 ratio, nor a ratio that generates 120 VAC, 115 VAC or 125 VAC in the tertiary winding) that must be corrected prior to using the tertiary winding voltage to calculate (and then control) the regulator output voltage as described above. This correction is required to normalize the PT output voltage to a conventional or standard turns ratio. The normalized or corrected tertiary winding voltage can be used to control the tap changer during forward power flow and during reverse power flow.

In certain prior art voltage regulators, the tertiary winding non-standard turns ratio is corrected or converted to a standard turns ratio by connecting the tertiary winding to a primary winding of a dry-type ratio correction transformer. The secondary winding of the ratio correction transformer is connected to the control panel. This ratio correction transformer can typically change the tertiary winding voltage by between about +/−1 volt and +/−20 volts. This correction ensures that the voltage input to the control panel from the secondary winding of the ratio correction transformer (for both the forward and reverse power flow cases) represents a voltage supplied from a transformer with a standard turns ratio.

To eliminate costs associated with the PT 36 of FIG. 1, a PT is not present in another prior art voltage regulator, i.e., an ANSI Type A regulator without a PT as illustrated in FIG. 2 and designated by reference character 50. For the forward direction of power flow indicated by the arrowhead 15, the regulator 50 measures the source-side voltage across the tertiary winding 30 (correcting the voltage to a conventional turns ratio as described above using a dry-type transformer). The control panel calculates the load-side voltage across the L and SL bushings from the measured and corrected tertiary winding voltage and from a position of the tap changer 18, as that position is tracked, updated and stored in a control panel memory. The controller controls the tap changer motor to move the tap changer 18 based on the calculated output voltage and a desired reference voltage. Commonly-owned U.S. Pat. No. 7,023,193, which is incorporated herein by reference, discloses and claims such a voltage regulator.

In a case of reverse power flow through the regulator 50, as indicated by the arrowhead 39, the load-side voltage is measured across the tertiary winding (correcting the voltage as described above). This load-side voltage is used by the voltage regulator 50 to control the tap changer 18 to produce the desired output voltage from the voltage regulator 50.

In the various scenarios described above, once the load-side voltage is known (either measured directly or calculated) the tap changer is controlled to supply the desired regulated load-side voltage. As described above, the Type A regulator, either with or without a PT, can accommodate both forward and reverse power flows.

Certain installations use an ANSI Type B regulator (also referred to as an "inverted" regulator) such as illustrated in FIGS. 3 and 4. There are no operational or functional differences between Type A and B regulators; they can be used interchangeably. A Type B regulator comprises many of the same components as a Type A regulator.

Forward power flow through a Type B regulator 70 without a PT is illustrated in FIG. 3 with the forward power flow direction indicated by the arrowhead 15. The voltage across the tertiary winding 30 (connected across the L and SL bushings, which for forward power flow represents the load side) is measured and corrected to a standard turns ratio as described above. The corrected load-side voltage is input to the voltage regulator controller and compared with the desired reference or set point voltage. The difference between these two values controls the tap changer motor, operating the tap changer to change the load-side voltage to the desired value.

For reverse power flow, as indicated by the arrowhead 39 in FIG. 3, the regulator 70 measures the source-side voltage across the tertiary winding 30 (correcting the voltage as described above). The control panel calculates the load-side voltage across the S and SL bushings from the measured and corrected tertiary winding voltage and from a position of the tap changer 18 as stored in memory. Responsive to the calculated load-side voltage, the control panel controls the tap changer 18 to produce the desired output voltage.

A Type B regulator 80 in FIG. 4 includes the PT 36 between the S and SL terminals. For forward power flow, as indicated by the arrowhead 15, the voltage across the tertiary winding 30 (the load side) is measured and corrected as described above. This voltage is used to control the tap changer 18 to produce the desired load-side voltage.

For reverse power flow as indicated by the arrowhead 39 in FIG. 4, the voltage across the PT 36 (the load side) is measured and the measured voltage input to the regulator controller for operating the tap changer 18 to provide the desired output voltage.

The majority of voltage regulators include a tertiary winding to generate voltages that power components of the voltage regulator. Many voltage regulators do not include a PT. In fact, a PT is not required for proper operation of the voltage regulator. But in those installations where a voltage regulator does not include a tertiary winding, a PT is installed in lieu of the tertiary winding; this PT is typically installed on the load bushing side of the voltage regulator. However, there is no application or operational differences between a voltage regulator without a tertiary winding and the regulator embodiments described above.

Some utilities require voltage regulators with external test terminals for use by a technician to attach voltmeter probes and read a voltage on a voltmeter display. However, the ability to measure and display these voltages is not necessary for proper operation of the voltage regulator.

There are several industry-standard common turns ratios for a potential transformer, such as 7200:120 (or 60:1). Thus for a voltage regulator including a PT, a service technician measures the PT secondary voltage with a hand held voltmeter or similar instrument and expects to read a voltage that is a 60:1 fraction of the line voltage.

For those voltage regulators that include a tertiary winding, the tertiary winding voltage can also be supplied to external test terminals for measuring by a service technician. Although tertiary windings have an accurate turns ratio, they typically do not have a standard or conventional turns ratios, such as 7200:120. Instead, a tertiary winding may exhibit a winding ratio of 7200:117 due to limitations imposed during the manufacturing process. Although these non-standard voltages could be made available at external test terminals, these voltages are not easily interpreted by a service technician accustomed to working with transformers that produce "standard" voltages generated by transformers with a "standard" winding ratio, such as potential transformers. Thus many utilities require scaling of the tertiary winding voltage to reflect a common turns ratio for measuring at the external test terminals.

To satisfy these requirements, certain voltage regulators have the ratio correction transformer mounted outside the voltage regulator for access by a service technician. For example, the ratio correction transformer comprises connections to provide a ratio of 117:120 to overcome the effect of the non-standard turns ratio of the tertiary winding. Thus the output voltage from the ratio correction transformer provides a familiar voltage that reflects a conventional transformer turns ratio, for example 60:1 for the tertiary winding operating in combination with the ratio correction transformer. These ratio-corrected voltages are supplied to the measurement input of the control panel and are subsequently made available at the external test terminals to meet the utility's requirements for an external test terminal that provides a voltage based on a conventional transformer turns ratio.

As an alternative to using the ratio correction transformer, some prior art voltage regulator control panels use a numerical correction factor to adjust a first digital value, the first digital value representing a voltage across the tertiary winding, to a second digital value that represents an output voltage from a transformer with a standard turns ratio.

Specifically, this numerical correction factor, which is fixed according to a fixed predetermined regulator setting, adjusts the digital representation of the RMS analog voltage from the tertiary winding as that value is stored in the control panel memory. For example, as described above, a voltage regulator may use a tertiary winding with a transformer ratio of 7200:117 to determine the voltage on the load side of the voltage regulator. The control panel numerically adjusts the digital representation of the analog RMS value stored in memory to generate a new digital value that reflects the desired transformer turns ratio of 7200:120.

However, the digital value is not supplied to external test terminals for use by service technicians in measuring a voltage regulator source voltage or load voltage. In fact, the digital value has no meaning to service technicians as they are familiar only with the measurement of AC values at the external test terminals.

This alternative technique for correcting the non-standard turns ratio of the tertiary winding poses a disadvantage by eliminating the ratio correction transformer. Without the ratio correction transformer there is no analog voltage to supply to the regulator external test terminals for measuring by a lineman or service technician. It is customary in the utility industry for the service technician to measure the regulator output voltage using a handheld voltmeter. In this case, the voltage measurement is ratio corrected at the digital level and therefore the voltage to be measured at the test terminals is not ratio corrected. If the service technician performing the measurement does not consider this, he will misinterpret the voltage measured at the test terminals and can inadvertently manually raise or lower the voltage beyond prescribed limits.

Many utilities require external test terminals where a regulated voltage based on a standard turns ratio is available for both forward and reverse power flows. For a voltage regulator providing bidirectional regulation, this feature requires both a PT and a combination of a tertiary winding and a ratio correction transformer. One of these transformers determines the load-side voltage for forward power flow and the other determines the load-side voltage for reverse power flow.

For a Type A regulator providing only forward power flow regulation, customers typically require a PT (which for a Type A regulator is disposed on the load bushing side), in addition to the tertiary winding on the source bushing side for powering the regulator. See the prior art voltage regulator illustrated in FIG. 1. For a Type B regulator a ratio correction transformer is required for use with the tertiary winding disposed on the load bushing side. See FIG. 4.

Thus as can been seen, in the prior art additional hardware components are required to produce "standard" voltages and make them externally available to meet utility requirements and preferences.

The inventor has recognized that avoiding use of the ratio correction transformer substantially reduces the voltage regulator cost. If the PT can also be eliminated, the cost is further reduced.

BRIEF DESCRIPTION OF THE DRAWINGS

The invention is explained in the following description in view of the drawings that show.

DETAILED DESCRIPTION OF THE INVENTION

Figure 1:
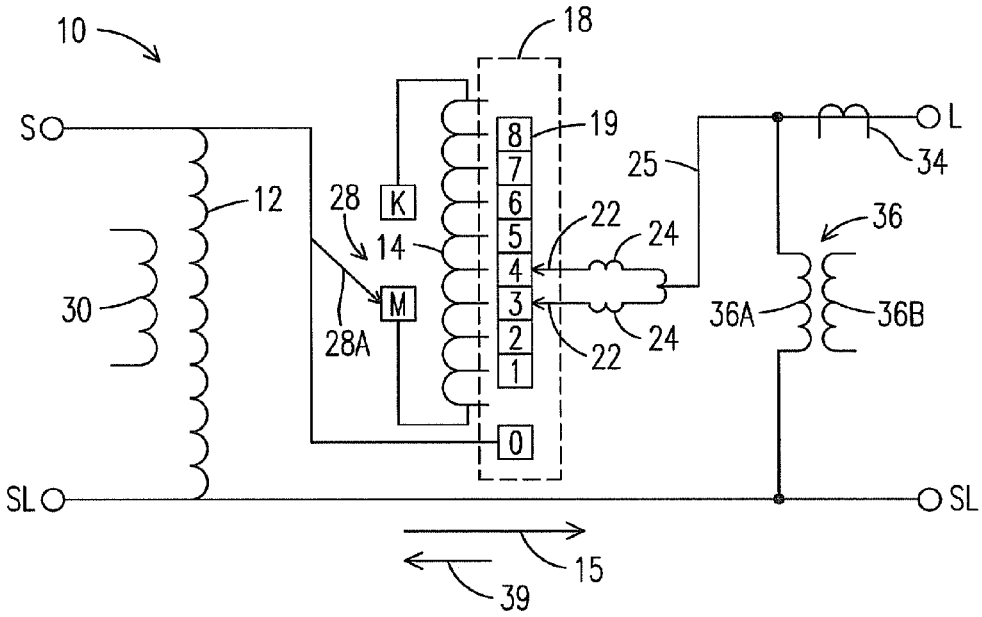
FIG. 1 PRIOR ART
FIGS. 1-4 illustrate various embodiments of prior art voltage regulators.
Figure 2:
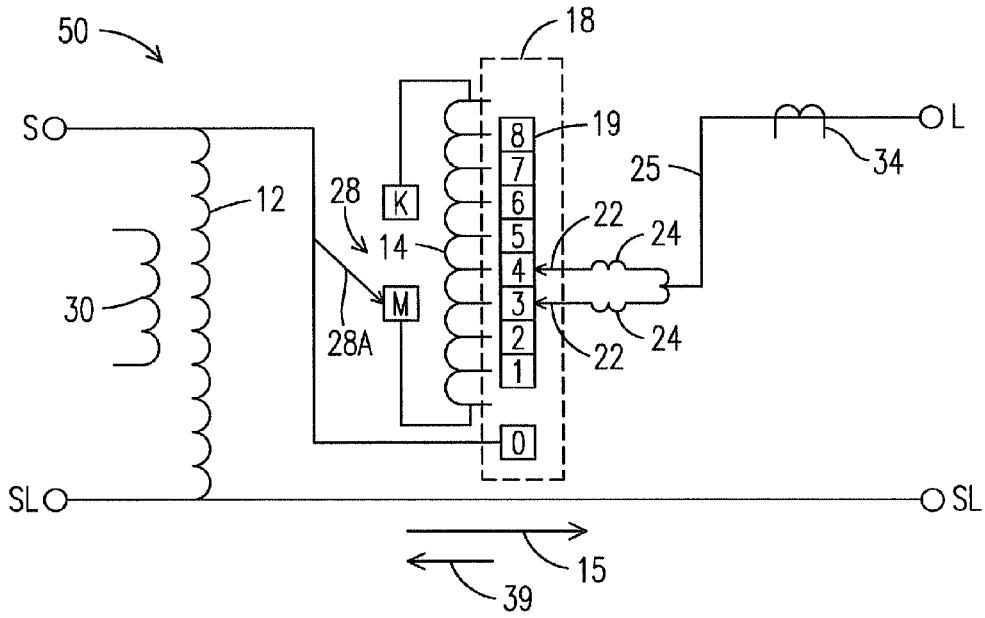
FIG. 2 PRIOR ART
Figure 3:
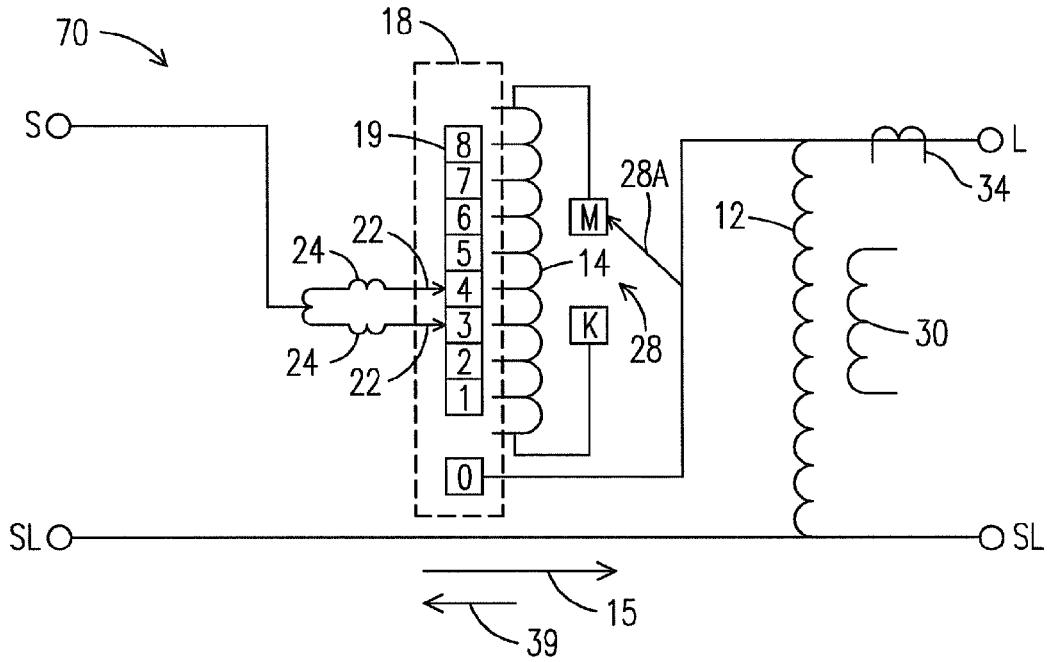
FIG. 3 PRIOR ART
Figure 4:
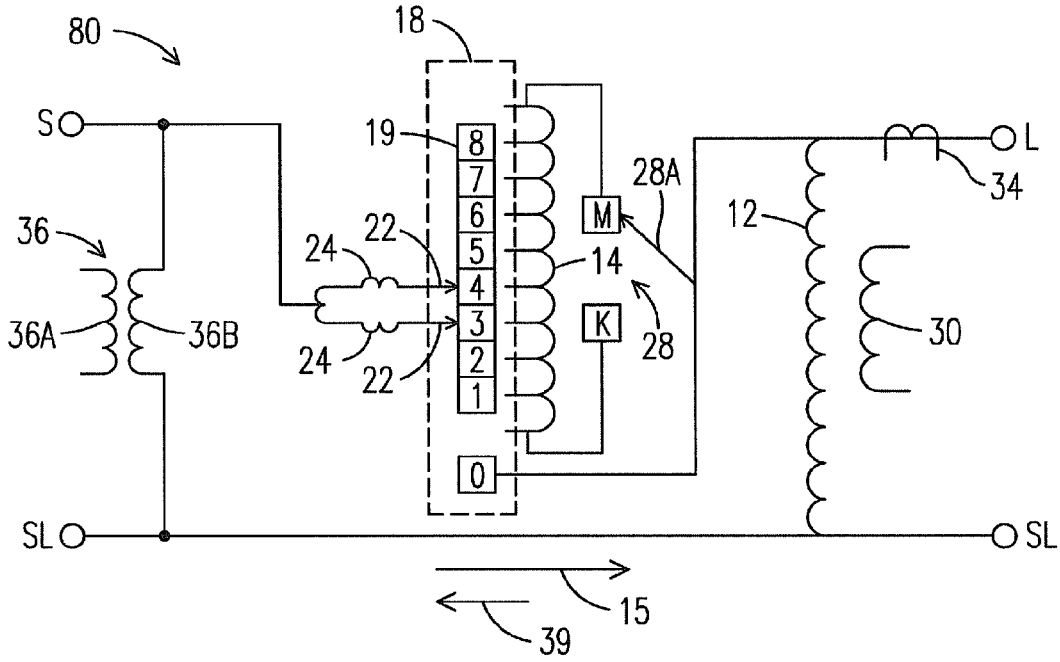
FIG. 4 PRIOR ART

Before describing in detail the particular apparatus and method for generating a metering voltage output from a voltage regulator using a microprocessor in accordance with various aspects of the present invention, it should be observed that the present invention, in its various embodiments, resides primarily in a novel and non-obvious combination of hardware and method steps related to this apparatus and method. Accordingly, the hardware elements and method steps have been represented by conventional elements in the drawings, showing only those specific details that are pertinent to the present invention so as not to obscure the disclosure with structural details that will be readily apparent to those skilled in the art having the benefit of the description herein.

The following embodiments are not intended to define limits of the structures or methods of the invention, but only to provide exemplary constructions. The embodiments are permissive rather than mandatory and illustrative rather than exhaustive.

The present invention overcomes the disadvantages of the prior art as described above. The present invention serves as a substitute for either one of the PT and the ratio correction transformer, as the invention can provide the functionality of the ratio correction transformer and/or simulate operation of the PT. In fact, the present invention can substitute for both the PT and ratio correction transformer at various times as selected by a user albeit a single implementation cannot substitute for both simultaneously.

The apparatus of the present invention is responsive to a voltage supplied from a transformer winding, e.g., a tertiary winding, with the primary winding (e.g., the exciting winding) responsive to a distribution system voltage. The primary winding is coupled to the tertiary winding with a non-standard turns ratio. Generally any turns ratio that does not generate a tertiary voltage of 120 VAC, 115 VAC, or 125 VAC is considered a non-standard turns ratio. Examples of such non-standard turns ratios include: 7200:117, 7200:119, 2500:117.5, 7620:123, 14400:121.5, 13200:114, 14400:126, 19900:118, etc. The control panel of the present invention generates a voltage having a value that would have been present if the transformer had a standard turns ratio, such as a ratio of 60:1 or 63.5:1. The corrected voltage (e.g., 120 VAC, 115 VAC and 125 VAC) is also made available for measuring at external test terminals of the control panel. Thus according to the present invention a ratio correction transformer of the prior art is not required.

Depending on the direction of power flow (that is, for a Type A voltage regulator), the transformer primary winding is responsive either to the load bushing side voltage or the source bushing side voltage. In the former scenario, the tertiary voltage, which represents the load-side voltage, is simulated to reflect a standard turns ratio and the resulting voltage controls the tap changer. In the latter scenario the load-side voltage (i.e., the regulated voltage) is determined from the measured and corrected source bushing side voltage and the position of the tap changer. In either situation, the voltage from the tertiary winding is corrected using a correction factor.

The correction factor can be a value that is added to or subtracted from the tertiary winding voltage to produce a corrected voltage, i.e., a corrected tertiary voltage, that would have been produced from a transformer having a standard turns ratio. For example, if a desired ratio is 7200:120, but the ratio between the exciting winding and the tertiary winding is 7200:117, then a correction factor of three is added to the tertiary winding voltage.

Alternatively, the correction factor can be a multiplicative factor that is multiplied by the tertiary winding voltage to produce a corrected tertiary voltage. In the example presented immediately above, the multiplicative factor is 120/117=1.026.

Different correction factors can be used to correct the tertiary winding voltage. The specific correction factor is dependent on the arithmetic operation to be performed to produce the corrected tertiary voltage.

In regulating the output voltage of the voltage regulator, the present invention provides the same functionality as the prior art voltage regulators, but adds important features that are not present in the prior art voltage regulators and eliminates certain components, such as the ratio correction transformer and the PT, and the costs associated with these components.

In a Type A voltage regulator when operating with forward power flow, the load bushing side PT is not required as the present invention simulates the load bushing side PT voltage (reflecting a standard PT turns ratio) based on the source bushing side tertiary winding voltage, the position of the tap changer and a conventional PT turns ratio. The simulated load bushing side PT voltage controls the tap changer and provides a voltage that reflects a standard turns ratio voltage at the external test terminals. In this application it is not necessary to use a ratio correction transformer or a PT, as the PT voltage can be simulated.

For reverse power flow using a Type A regulator, the present invention uses the voltage present on the tertiary winding (connected across the source bushing side, which for reverse power flow is the load side) to determine the load-side voltage. The invention can simulate the load bushing side PT voltage based on the measured source bushing side tertiary winding voltage. Alternatively, the present invention can correct the tertiary winding voltage, using a correction factor, and use the corrected tertiary winding voltage to control the tap changer. A ratio correction transformer is not required.

For a Type B regulator for forward power flow, again a ratio correction transformer is not required for use with the load bushing side tertiary winding, as operation of the ratio correction transformer is simulated using the correction factor of the present invention. A PT on the source bushing side can be simulated, if required, based on the measured load bushing side tertiary voltage and the tap changer position.

For reverse power flow for a Type B regulator, the source bushing side PT voltage (which for reverse power flow is on the load side) is simulated based on the load bushing side tertiary winding voltage (which now represents the source-side voltage) and the tap changer position.

Any of the simulated and/or corrected voltages described above can be supplied to external test terminals on the voltage regulator for use by a technician to measure the voltage.

Within the microprocessor-based voltage regulator of the present invention, the various described voltages are represented by digital values. It is not necessary to convert the digital values to the corresponding analog voltages that they represent to carry out the control functions of the regulator. But to supply a conventional analog voltage to the external test terminals the digital value representing that voltage must first be converted to the corresponding analog voltage.

A detailed description of the various scenarios in which the voltage regulator of the present invention can be utilized follows. In certain scenarios the voltage regulator may include a PT and/or may include a tertiary winding at the discretion of the utility customer. The present invention can be used with any regulator that includes one or both of a PT and tertiary winding.

(A) Type A regulator with a PT between the L and SL bushings (the load-side terminals) and a tertiary winding between the S and SL bushings (the source-side terminals):

For forward power flow, the control panel regulates the voltage supplied to the distribution system responsive to a measured load-side voltage across the PT.

For reverse power flow, the control panel regulates the voltage supplied to the distribution system responsive to a measured tertiary winding voltage (which for this case of reverse power flow is on the load side). A ratio correction transformer is required, according to the prior art, to produce a corrected voltage based on the tertiary winding voltage, where the corrected voltage represents a voltage derived from a standard turns ratio transformer. According to the present invention the ratio correction transformer is not required. Instead the control panel simulates a ratio-corrected tertiary winding voltage responsive to the measured tertiary winding voltage and a correction factor. By simulating the ratio-corrected tertiary winding voltage for reverse power flow, the present invention avoids the expense of a ratio correction transformer, with no degradation in functionality.

If the utility customer requires supplying the regulated (load side) voltage to external test terminals for forward power flow, the measured voltage across the PT can be used to meet this requirement.

If the utility customer requires supplying the regulated voltage to external test terminals for measurement during reverse power flow, a ratio correction transformer is required according to the prior art to provide a conventional voltage at the test terminals. But again, a ratio correction transformer is not required according to the present invention. Instead, according to the present invention, the simulated ratio-corrected tertiary winding voltage is supplied to the test terminals.

(B) Type A regulator without a PT and with a tertiary winding between the S and SL terminals.

For forward power flow the control panel regulates the voltage supplied to the distribution system responsive to a calculated load-side voltage. This voltage is calculated by measuring the source-side voltage across the tertiary winding and then applying a correction factor to determine the source-side voltage that would have been provided by a ratio correction transformer. The load-side voltage is then determined from the corrected source-side voltage and the tap changer position.

For reverse power flow, the control panel regulates the voltage supplied to the distribution system responsive to a measured and corrected tertiary winding voltage (which in this scenario is on the load side).

For forward power flow, the present invention simulates the load bushing side PT output voltage as though a PT had been employed. An actual PT is not required by the present invention. For reverse power flow, the present invention simulates the tertiary winding output voltage as if a ratio correction transformer had been employed (or as if the tertiary winding and the exciting winding had a standard or conventional turns ratio relation). A ratio correction transformer is not required by the present invention.

In both the forward and reverse power flow cases, the resulting simulated voltage may be supplied to the external terminals where the voltage can be measured using a voltmeter.

(C) Type A regulator with a PT between the L and SL terminals and no tertiary winding.

For forward power flow, the control panel regulates the voltage supplied to the distribution system responsive to a measured load bushing voltage across the PT. According to this scenario with a PT on the load bushing side, the invention can simulate the voltage on the source bushing side.

For reverse power flow, the control panel regulates the voltage supplied to the distribution system responsive to a calculated load-side voltage. Note that for this case of reverse power flow the PT is on the source side. The load-side voltage is calculated based on the measured load bushing side voltage across the PT (the source voltage) and the position of the tap changer. The present invention simulates this calculated load-side voltage and supplies the voltage to external test terminals, in lieu of supplying a load bushing side PT voltage (which for the case of reverse power flow represents the source voltage) to the test terminals.

In both cases of forward and reverse power flow, if a utility customer requires supplying a load-side voltage to the external test terminals, the measured (for forward power flow) or simulated (for reverse power flow) load-side voltage, determined as explained above, is supplied to the test terminals.

(D) Type B regulator without a PT and with a tertiary winding between the L and SL terminals:

For forward power flow, the control panel regulates the voltage supplied to the distribution system responsive to a measured and corrected tertiary winding voltage, the correction to overcome the effects of the non-standard turns ratio of the tertiary winding.

For reverse power flow, the control panel regulates the voltage supplied to the distribution system responsive to a calculated load-side voltage based on the measured and corrected tertiary winding voltage and the position of the tap changer.

For both forward and reverse power flow, the present invention simulates an output voltage equivalent to that which would have been present if tertiary winding employed a conventional turns ratio. Also, in both power flow cases, the simulated voltage can be supplied to the external terminals for measurement using a voltmeter. And in both cases the invention simulates a source-bushing side PT voltage.

For both forward and reverse power flow, the user can connect the voltage representing the distribution system voltage to external test terminals for use by a utility technician.

A ratio correction transformer is not required according to the present invention. Also, in this scenario an actual PT is not present; a PT is instead simulated.

(E) Type B regulator with a PT between the S and SL terminals and with a tertiary winding between the L and SL terminals.

For forward power flow, the control panel regulates the voltage supplied to the distribution system responsive to a measured and corrected tertiary winding voltage (which for forward power flow is on the load side).

For reverse power flow, the control panel regulates the voltage supplied to the distribution system responsive to a measured load voltage across the PT (which for reverse power flow is on the load side).

In both cases, the present invention simulates the tertiary winding output voltage by generating a voltage that would have been present if the tertiary winding employed a conventional turns ratio. A ratio correction transformer is not required. In both the forward and reverse power flow cases, either this simulated tertiary winding voltage is supplied to the external terminals or, alternatively, the PT voltage can be supplied to the test terminals.

(F) Type B regulator with a PT between the L and SL terminals but without a tertiary winding.

For forward power flow, the control panel regulates the voltage supplied to the distribution system responsive to a measured load voltage across the PT.

For reverse power flow, the control panel regulates the voltage supplied to the distribution system responsive to a calculated load-side voltage (which for this case of reverse power flow is on the source bushing side). The load-side voltage is calculated based on the measured source-side voltage across the PT and the position of the tap changer. The invention simulates this calculated load voltage and supplies this voltage to the external test terminals.

In both cases of forward and reverse power flow if a utility customer requires a measured voltage at external test terminals the measured or simulated load-side voltage, determined as explained above, is supplied to the test terminals.

There are four additional scenarios for which the present invention can be utilized:

(G) A Type A voltage regulator with a PT on each of the source bushing side and the load bushing side.

(H) A Type B regulator with a PT on each of the source and load bushing sides.

Generally, the invention does not have any practical utility when applied to the (G) and (H) scenarios if each PT employs a standard turns ratio.

(I) A Type A voltage regulator with a single PT on the source bushing side.

(J) A Type B voltage regulator with a single PT on the source bushing side.

The (I) and (J) implementations are not available from any regulator manufacturer as the (C) and (F) cases described above have about the same cost and the same internal components, but are more desirable to an end user.

Other scenarios and applications for the present invention can be inferred from the above applications by those skilled in the art.

Generally, there are only six situations of particular interest, and in each situation the load voltage, which is used to control the tap changer and thus control the voltage on the distribution system, is the most critical component. The load voltage must therefore be determined by one of these techniques:

(a) measured directly by a utility winding across the load-side bushings for a case of forward power flow;

(b) measured directly by a utility winding across the source-side bushings for a case of reverse power flow;

(c) measured directly by a PT across the load-side bushings for a case of forward power flow;

(d) measured directly by a PT across the source-side bushings for a case of reverse power flow;

(e) simulated across the load-side bushings for a case of forward power flow;

(f) simulated across the source-side bushings for a case of reverse power flow.

Thus the invention is ideally suited for simulating a tertiary winding turns ratio having a conventional turns ratio and/or simulating the PT output voltage. As the various cases set forth above illustrate, the invention can be used with a regulator with or without a PT and with or without a tertiary winding. Without adding the cost and complexity of one or more of a potential transformer, a ratio correction transformer and a tertiary winding, the present invention provides measurable voltages using electronic components to produce a voltage that is equivalent to a distribution voltage that would be measured on a legacy distribution system with a PT. Advantageously, the present invention can also operate with either forward or reverse power flow.

In the embodiments described above, a microprocessor receives a digital value representing an AC voltage output from a tertiary winding, with the primary winding formed by the exciting winding (reference character 12 in FIGS. 1-4). The microprocessor generates a corrected digital value representing an RMS voltage that would have been produced from a transformer with a conventional turns ratio, i.e., obviating the non-standard turns ratio of the tertiary winding. This corrected digital value is generated by adding or subtracting a voltage scaling factor to the digital value. As described elsewhere herein, the corrected digital value can also be generated by multiplying by an appropriate correction factor.

The microprocessor-based voltage regulator control panel uses a DAC to convert the corrected digital value to a relatively small AC voltage and supplies the AC voltage to a step-up transformer to generate an AC voltage of increased magnitude.

The microprocessor can also simulate operation of a PT based on the corrected digital value, for example, producing a simulated PT output voltage.

In one embodiment either or both of the AC voltage derived from the corrected digital value or the simulated PT output voltage is supplied to external test terminals for measurement by a service technician using a voltmeter.

Figure 5:
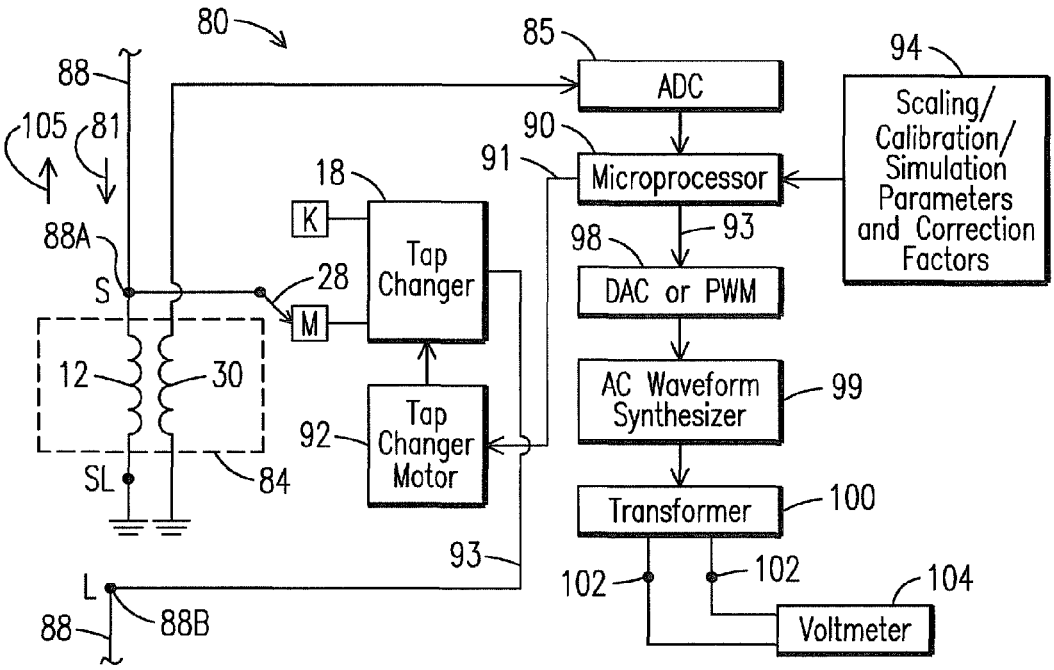
FIG. 5 is a block diagram that illustrates a first installation of the voltage regulator of the present invention.

A block diagram of FIG. 5 (which is a Type A voltage regulator without a PT and with a tertiary winding between the S and SL terminals) depicts the principal functional blocks of a voltage regulator 80 constructed according to the teachings of the present invention. Power flow is in a direction indicated by an arrowhead 81. A transformer 84 comprises a winding further comprising the tertiary winding 30 and a primary winding further comprising the exciting winding 12. The transformer 84 has a non-standard turns ratio between its primary and tertiary windings.

The transformer 84 is connected to a distribution system conductor 88 (only one conductor illustrated although the invention is typically used on a three phase distribution system) at a location 88A or an S terminal. The voltage regulator 80 senses the distribution system line voltage at the S terminal and controls or stabilizes the line voltage by supplying a voltage, within a predetermined range, at a location 88B or an L terminal (i.e., the load side).

In operation, the tertiary winding voltage of the transformer 84 is input to an analog-to-digital-converter 85 where the analog voltage (RMS value) is converted to a tertiary digital value. From the ADC 85 the tertiary digital value is input to a microprocessor 90.

The microprocessor 90 is also responsive to scaling/calibration/simulation parameters and correction factors from components and software settings represented by a block 94. These parameters allow the microprocessor 90 to correct the digital tertiary value according to the operational parameters of the microprocessor 90 and a difference between the non-standard winding ratio of the transformer 84 and a conventional turns ratio.

The block 94 also supplies the microprocessor 90 with a set point value that represents the desired voltage on the distribution system. As known by those skilled in the art, the set point value is typically in a range of 110-130 VAC. But the tap changer is actually adjusting 7200 volts, for example, on the distribution system. A 120 volt set point value with a 60:1 transformer turns ratio is equivalent to 7200 VAC on the distribution system. A 115 VAC set point value is equivalent to 6900 VAC, which may be regarded as a low voltage on the distribution system.

After scaling or correcting the tertiary digital value, the microprocessor 90 calculates the regulator output load-side voltage from this tertiary digital value and the tap changer position. Note that in FIG. 5 the measured voltage from the tertiary winding 30 is on the source-side bushing of the voltage regulator 80 and therefore this calculation is required.

The microprocessor 90 compares the resultant calculated load-side digital value with the reference voltage set point and produces a control signal on a conductor 91. The control signal operates the tap changer motor 92 to control the tap changer 18 to supply a corresponding voltage at the location 88B or the L terminal.

The calculated load-side digital value is also used to simulate operation of a PT, i.e., generating a voltage that represents or simulates the output voltage of a load-side PT with a standard turns ratio. The turns ratio of the transformer 84, the measured tertiary winding voltage and the tap changer position determine the simulated PT output voltage. If the turns ratio of the transformer 84 is determined to be, for example, 7200:118.2 and it is known that the turns ratio of a standard PT is 7200:120, then the correction factor is +1.8. Therefore, if the tertiary winding voltage is 119.7 VAC and the tap changer is in a neutral position, (i.e., output voltage equals input voltage), the digital output value from the microprocessor represents 121.5 VAC. Mathematically, for a +/−10%, 32-step voltage regulator, Vout=(1+(tap changer position)×0.00625)×Vin.

As can be deduced from the explanation of the present invention, in an application where the voltage regulator comprises a PT and no tertiary winding, a correction factor is required only if the PT has a non-standard turns ratio. In an application where the voltage regulator comprises a tertiary winding but no PT, the correction factor is used.

As the voltage on the distribution system changes with time and the voltage produced by the tertiary winding 30 changes accordingly, the same correction factor value is applied to a digital value representing the tertiary winding voltage to correct for the non-standard turns ratio. The corrected tertiary winding voltage and the tap changer position are used to simulate the PT.

Since the correction factor is based on a difference between the turns ratio of the transformer 84 and a conventional turns ratio, the correction factor can be regarded as a physical constant.

The correction factor is applied only to the digital value representing the RMS tertiary winding voltage; it is not applied to the tertiary analog output voltage or to any other analog voltage present in the voltage regulator. The correction factor replaces, on a functional level, the ratio correction transformer.

As described above, in the prior art the ratio correction transformer changes the tertiary analog output voltage. This ratio-corrected tertiary analog output voltage is then converted to a digital value that reflects use of a standard turns ratio in the coupling between the exciting winding and the tertiary winding. Without use of the ratio correction transformer the non-standard turns ratio generates an incorrect digital value. In contrast, the present invention teaches applying the correction factor to the digital value representing the RMS tertiary analog output voltage. Thus the resulting corrected digital value represents an RMS analog output voltage from a transformer with a standard or conventional turns ratio.

Returning to FIG. 5, a signal on a conductor 93 from the microprocessor 90 is a digital value that represents the tertiary winding voltage, corrected by the correction factor as described above. The digital value is input to a digital-to-analog converter (DAC) or to a pulse width modulator (PWM) 98 to produce an analog voltage representative of the digital value. An R-2R digital-to-analog converter can also be used in lieu of the DAC or the PWM.

The analog voltage is supplied as an input to an AC waveform synthesizer 99 that generates an AC waveform at a higher current than the output signal from the DAC or PWM 98. This larger current is necessary to drive a transformer 100. The transformer 100 steps up the analog voltages of the AC waveform to an AC voltage in a range that includes the analog output voltage from a typical tertiary winding, but with a standard turns ratio. This voltage appears across external measurement terminals 102 to be measured by an external device, such as a voltmeter 104, used by a service technician.

Since the tertiary winding 12 in FIG. 5 is connected across the source-side bushings, the availability of this source-side voltage at the external terminals 102 satisfies the requirement of some utility users for a measurable voltage value that varies according to the voltage to be controlled, i.e., the source voltage. As the source voltage varies from a desired value, the voltage appearing across the measurement terminals 102 also varies and, importantly, this voltage reflects the voltage that would be present from a ratio correction transformer, coupled to the source-side bushing tertiary winding.

Continuing with FIG. 5, if the user wants to measure the output or load-side voltage at the terminals 102, for forward power flow, the microprocessor 90 calculates the actual output or load voltage based on digital values representing the corrected tertiary winding source-side voltage and the tap changer position. The load-side digital value is processed through the elements 98, 99 and 100 to the terminals 102. In essence, this load-side analog voltage simulates the output voltage from a load-side PT.

For reverse power flow, as indicated by an arrowhead 105, the corrected tertiary winding voltage between the S and SL terminals (which are now on the load side) represents the load-side voltage. The microprocessor 90 uses the digital value representing this voltage to operate the tap changer as required. This digital value can be processed through the elements 98, 99 and 100 and the resulting analog voltage supplied to the external terminals 102 for measurement by a voltmeter 104.

If the user wants to display the source-side voltage for reverse power flow, the microprocessor 90 calculates a digital representation of the source-side voltage from the actual output or load voltage (from the corrected tertiary winding load-side voltage) and the tap changer position. The resulting digital value is processed through elements 98, 99 and 100 and the resulting analog voltage is supplied to the external terminals 102 for measuring by the voltmeter 104. In essence, this source-side voltage simulates the output voltage from a source-side PT.

Thus as can be seen from the above discussion, the present invention provides the same functionality as a prior art Type A or Type B regulator with either a PT or tertiary winding on the source bushing side. The user can select the voltage to apply to the test terminals 102, i.e., either the unregulated source-side voltage or the regulated load-side voltage for both forward and reverse power flow.

A numerical example is presented. Assume the voltage on the distribution system 88 of FIG. 5 is 7200 VAC, the transformer 84 has a turns ratio of 7200:117 between the primary winding 12 and the tertiary winding 30 and is positioned on the source bushing side. Assume a standard turns ratio is 7200:120. The microprocessor 90 applies the correction factor to a digital representation of the output/tertiary winding of the transformer 84 to calculate a digital voltage that represents 120 VAC from a source bushing side tertiary winding with a standard turns ratio. This digital value is placed on the conductor 93. The DAC or PWM 98 converts the digital value to an analog voltage and the transformer 100 steps up the analog voltage to a value that reflects a standard turns ratio transformer, with the transformer primary responsive to the distribution system voltage. This analog voltage can be measured at the terminals 102. In the same manner, the load-side voltage can be simulated by the microprocessor using the additional input of the tap changer position.

Figure 6:
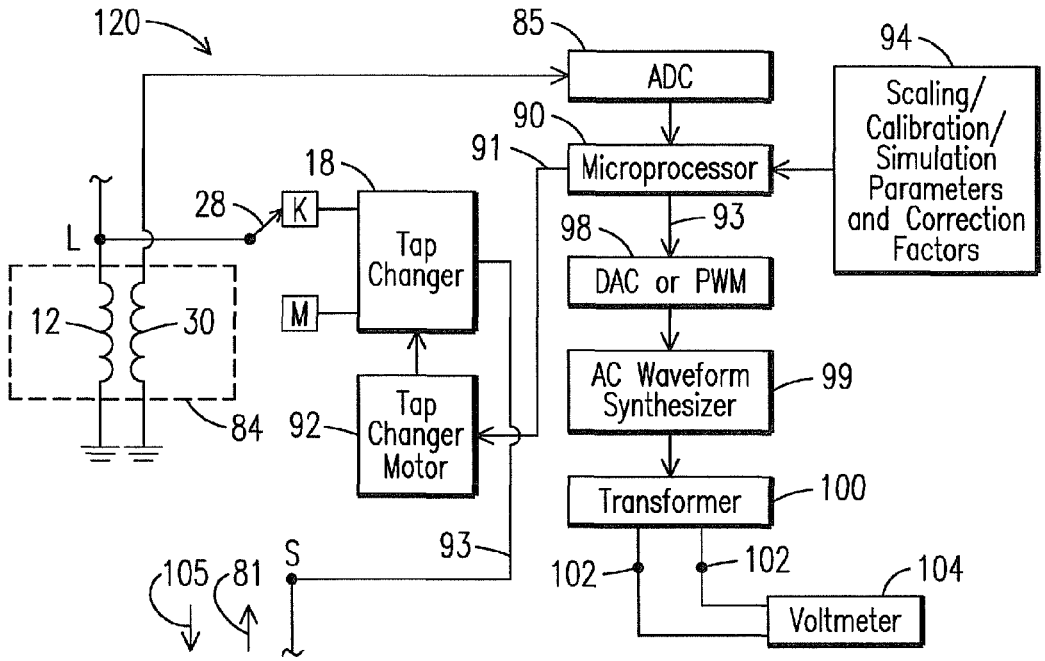
FIG. 6 is a block diagram that illustrates a second installation of the voltage regulator of the present invention.

FIG. 6 illustrates an embodiment where the transformer 84 (comprising the exciting winding primary 12 and the tertiary winding 30) is on the load bushing side of a regulator 120. Forward power flow direction is indicated by the arrowhead 81 and reverse power flow by the arrowhead 105. The FIG. 6 embodiment is analogous to the Type B voltage regulator illustrated in FIG. 3.

In the FIG. 6 embodiment it is not necessary for the microprocessor 90 to perform any calculations for forward power flow as the transformer 84 directly measures the regulator output voltage (load side) and supplies the measured voltage to the microprocessor 90 via the ADC 85. The ADC 85 outputs a digital value representing the load bushing side voltage and the microprocessor 90 applies the correction factor to that digital value to compensate the non-standard turns ratio of the transformer 84/tertiary winding 30. The corrected digital value is processed through the elements 98, 99 and 100 and can be measured at the terminals 102 as in FIG. 5.

The microprocessor 90 can also simulates a source bushing side PT voltage by using the corrected tertiary winding voltage and the tap position, as described above.

For reverse power flow, as indicated by the arrowhead 105, the transformer 84 is on the source side of the voltage regulator 120. The voltage across the transformer 84 is thus the source-side voltage. The load side or regulated voltage is determined from the measured source-side voltage by applying the correction factor and the position of the tap changer. The load-side voltage is used to control the tap changer to achieve the desired regulated or output voltage. Operation of a source-side PT can also be simulated as described above.

Figure 7:
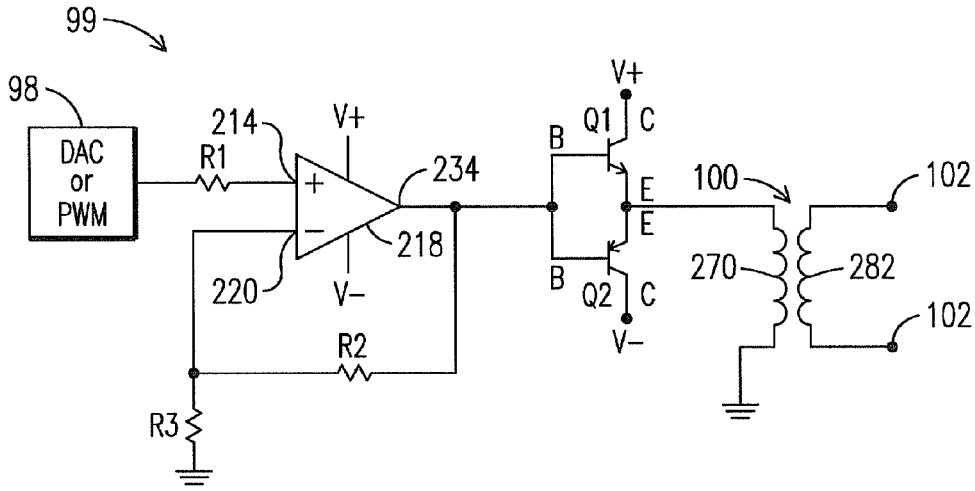
FIG. 7 is a schematic diagram of a waveform synthesizer of FIGS. 5 and 6.

One example of a circuit for implementing the AC waveform synthesizer 99 of FIGS. 5 and 6 is illustrated in FIG. 7. An output signal from the digital-to-analog converter or the pulse width modulator 98 comprises a low voltage sine wave that is input to a non-inverting input terminal 214 of an operational amplifier 218 via a resistor R1. An inverting input terminal 220 of the operational amplifier 218 is connected to ground through a resistor R3. In one embodiment, the output from the operational amplifier 218 is a 12V peak (24 volts peak-to-peak) magnitude. However, the operational amplifier cannot generate a sufficiently large output current to drive a transformer.

Therefore the output from the operational amplifier 218 is input to a transistor circuit to further increase the current to a value sufficient to drive the transformer 100. An output terminal 234 of the operational amplifier 218 is connected to base terminals (B) of NPN transistor Q1 and PNP transistor Q2. The output terminal 234 is also connected to the inverting input terminal through a feedback resistor R2.

Emitter terminals (E) of the transistors Q1 and Q2 are connected together and connected to a primary winding 270 of the transformer 100. Collector terminals (C) of Q1 and Q2 are connected to proper polarity voltage sources, +V and −V.

The transistors Q1 and Q2 are controlled by the sine wave voltages on their base terminals to generate sine wave voltages at the junction of the two emitters. The output current from Q1 and Q2 is much larger than the output current from the operational amplifier 218 to effectively drive the transformer 100.

The transformer 100 comprises a primary winding 270 and a secondary winding 282. A measurable output voltage is present across the secondary winding 282 and connected to the accessible terminals 102.

In an embodiment using an operational amplifier with a higher current capacity than the operational amplifier 218, the transistors Q1 and Q2 may not be required as the operational amplifier current is sufficient to drive the transformer 100.

Figure 8:
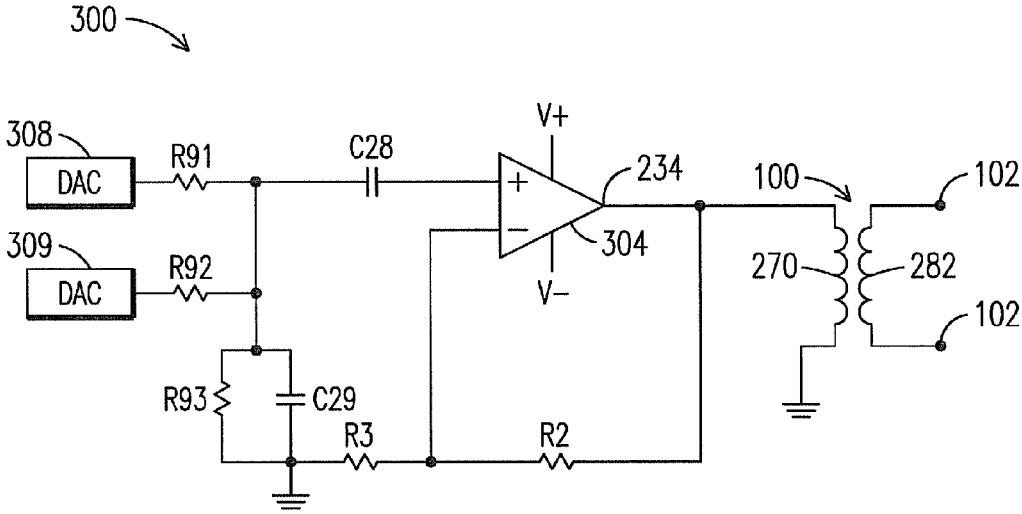
FIG. 8 is an alternative embodiment for the waveform synthesizer of FIG. 7.

FIG. 8 illustrates an alternative embodiment for the waveform synthesizer 99 of FIGS. 5 and 6. A waveform synthesizer 300 of FIG. 8 uses an operational amplifier 304 with a higher current capacity that can drive the transformer 100 directly. This embodiment also employs two DACs 308 and 309, rather than the single DAC 98 in FIGS. 5, 6 and 7. The two DACs 308 and 309 generate a higher resolution signal than a single DAC. The DAC 308 generates the analog signal near the zero-crossings and the DAC 309 generates the analog signal at peaks of the sine wave signal.

Capacitors C28 and C29 provide additional waveform conditioning, as is known by those skilled in the art.

The voltage regulator of the present invention can replace prior art voltage regulators that require a potential transformer and/or a ratio correction transformer to generate a controlled voltage. Further, the voltage regulator of the present invention can be used for both forward and reverse power flows.

The teachings of the present invention can also be applied to other systems on a power distribution network. For example, many legacy analog power monitoring, control and metering systems provide a measured value (e.g., voltage, current) at an equipment site or at a remote site. Since these systems are analog-based, the measured quantities conform to expected customary values because conventional analog-based equipment and transformers with standard winding ratios have been used for many years to provide the measured values. With the continued growth of digital monitoring, control and metering systems, it is no longer necessary to use or to present these customary measured values. Instead, the digital systems operate with much lower voltages and currents that are more convenient for digital signal processing. These systems may also employ transformers with non-standard turns ratios to generate these voltages and currents. The teachings of the present invention can be adapted to such digital systems to present an expected customary measured value, that is, a measured value that would have been expected from a legacy analog system.

Generally, the references to a transformer with a standard turns ratio include any transformer that generates a 120 VAC output on the secondary winding (or in certain limited applications a secondary output voltage of 125 VAC or 115 VAC).

The primary winding is responsive to any of the many distribution system voltages, for example 34.5, 19.9, 14.4, 13.2, 7.97, 7.62, 7.2, 5.0, 4.8, 4.33, 2.5 and 2.4 kV. Also, as used herein the term "secondary winding" refers to a transformer secondary winding or a transformer tertiary winding.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A voltage regulator for regulating a system voltage on a power distribution system, the voltage regulator comprising:

source-side bushings connected to the power distribution system at a first location;

load-side bushings connected to the power distribution system at a second location;

the system voltage across the load-side bushings for forward power flow and across the source-side bushings for reverse power flow;

a first transformer connected between one of the source side bushings or the load side bushings, the first transformer having a non-standard turns ratio between a primary winding and a secondary winding;

a second transformer connected between another of the source side bushings or the load side bushings, the second transformer having a standard turns ratio between a primary winding and a secondary winding;

the first transformer producing a first analog voltage and the second transformer producing a second analog voltage;

a first apparatus converting the first analog voltage to a first digital value and the second analog voltage to a second digital value;

a tap changer;

a microprocessor producing a corrected first digital value responsive to the first digital value and to a correction factor, the correction factor compensating the non-standard turns ratio of the first transformer;

the microprocessor producing a control signal operating the tap changer to regulate the system voltage to a desired value, the control signal responsive to one of the corrected first digital value and the second digital value;

a second apparatus converting the corrected first digital value to a corrected analog voltage; and conductors carrying at least one of the corrected analog voltage and the second analog voltage to accessible terminals of the voltage regulator, the terminals for receiving a measuring device for measuring a voltage between the terminals.

2. The voltage regulator of claim 1 wherein the first transformer comprises an exciting winding and a tertiary winding, the first analog voltage produced in the tertiary winding, the first analog voltage representing a source-side voltage for forward power flow and a load-side voltage for reverse power flow when the exciting winding is connected between the source-side bushings, and representing a load-side voltage for forward power flow and a source-side voltage for reverse power flow when the exciting winding is connected between the load-side bushings.

3. The voltage regulator of claim 1 wherein the second transformer comprises a potential transformer further comprising a primary winding and a secondary winding, the second analog voltage produced in the secondary winding, the second analog voltage representing a load-side voltage for forward power flow and a source-side voltage for reverse power flow when the second transformer is connected between the load-side bushings, and representing a source-side voltage for forward power flow and a load-side voltage for reverse power flow when the second transformer is connected between the source-side bushings.

4. The voltage regulator of claim 1 wherein when the first transformer is connected between the source-side bushings, the control signal is responsive to the corrected first digital value for reverse power flow and to the second digital value for forward power flow, and when the first transformer is connected between the load-side bushings, the control signal is responsive to the corrected first digital value for forward power flow and to the second digital value for reverse power flow.

5. The voltage regulator of claim 1 the second apparatus comprising one of a digital-to-analog converter, a pulse-width modulator and an R-2R resistor network.

6. The voltage regulator of claim 1 the second apparatus further comprising a step-up transformer increasing a magnitude of the corrected analog voltage.

7. The voltage regulator of claim 1 wherein the measuring device comprises a voltmeter or a multimeter.

8. The voltage regulator of claim 1 wherein the first transformer has a turns ratio such that the first analog voltage is not one of 120 VAC, 115 VAC and 125 VAC.

9. The voltage regulator of claim 1 wherein the correction factor comprises a positive or a negative DC correction factor and the microprocessor adds or subtracts the DC correction factor and the first digital value.

10. The voltage regulator of claim 1 wherein the correction factor comprises a multiplicative factor and the microprocessor multiplies the multiplicative factor and the first digital value.

11. The voltage regulator of claim 1 wherein the first digital value represents a root-mean-square of the first analog voltage and the second digital value represents a root-mean-square of the second analog voltage.

12. A voltage regulator for regulating a system voltage on a power distribution system, the voltage regulator comprising:

source-side bushings connected to the power distribution system at a first location;

load-side bushings connected to the power distribution system at a second location;

the system voltage to be regulated across the load-side bushings for forward power flow and across the source-side bushings for reverse power flow;

a first transformer connected between one of the source-side bushings or the load-side bushings, the first transformer having a non-standard turns ratio between a primary winding and a secondary winding and producing an analog voltage;

a first apparatus converting the analog voltage to a digital value;

a tap changer;

a microprocessor producing a corrected digital value responsive to the digital value and to a correction factor, the correction factor compensating the non-standard turns ratio of the first transformer;

the microprocessor producing a digital simulated PT value representing an output voltage of a potential transformer across another of the source-side bushings and the load-side bushings, the digital simulated PT value responsive to the corrected digital value and a tap changer position; and the microprocessor producing a control signal operating the tap changer to regulate the system voltage to a desired value, the control signal responsive to one of the corrected digital value and the digital simulated PT value;

a second apparatus converting at least one of the corrected digital value to a corrected analog voltage and the digital simulated PT value to an analog simulated PT voltage; and conductors carrying at least one of the corrected analog voltage and the analog simulated PT voltage to accessible terminals of the voltage regulator, the terminals for receiving a measuring device for measuring a voltage across the terminals, when the first transformer is connected across the source-side bushings, the corrected analog simulated PT voltage representing a load-side voltage for forward power flow and a source-side voltage for reverse power flow, when the first transformer is connected across the load-side bushings, the analog simulated PT voltage representing a source-side voltage for forward power flow and a load-side voltage for reverse power flow.

13. The voltage regulator of claim 12 wherein the first transformer comprises an exciting winding and a tertiary winding, the analog voltage produced in the tertiary winding, the analog voltage representing a source-side voltage for forward power flow and a load-side voltage for reverse power flow when the exciting winding is connected between the source side bushings, and representing a load-side voltage for forward power flow and a source-side voltage for reverse power flow when the exciting winding is connected between the load-side bushings.

14. The voltage regulator of claim 12 wherein when the first transformer is connected between the source-side bushings, the control signal is responsive to the corrected first digital value for reverse power flow and to the digital simulated PT value for forward power flow, and when the first transformer is connected between the load-side bushings, the control signal is responsive to the corrected first digital value for forward power flow and to the digital simulated PT value for reverse power flow.

15. The voltage regulator of claim 12 the second apparatus comprising one of a digital-to-analog converter, a pulse-width modulator and an R-2R resistor network.

16. The voltage regulator of claim 12 the second apparatus further comprising a step-up transformer increasing a magnitude of one of the corrected analog voltage and the analog simulated PT voltage.

17. The voltage regulator of claim 12 wherein the measuring device comprises a voltmeter or a multimeter.

18. The voltage regulator of claim 12 wherein the first transformer has a turns ratio such that the analog voltage is not one of 120 VAC, 115 VAC and 125 VAC.

19. The voltage regulator of claim 12 wherein the correction factor comprises a positive or a negative DC correction factor and the microprocessor adds or subtracts the DC correction factor and the digital value.

20. The voltage regulator of claim 12 wherein the correction factor comprises a multiplicative factor and the microprocessor multiplies the multiplicative factor and the digital value.

21. The voltage regulator of claim 12 wherein the digital value represents a root-mean-square of the analog voltage.

22. A voltage regulator regulating a system voltage of a power distribution system, the voltage regulator comprising:

source-side bushings connected to the power distribution system at a first location;

load-side bushings connected to the power distribution system at a second location;

the system voltage to be regulated across the load-side bushings for forward power flow and across the source-side bushings for reverse power flow;

a potential transformer comprising a primary winding connected between the load-side bushings and a secondary winding, an analog PT voltage produced in the secondary winding, the analog PT voltage representing a load-side voltage for forward power flow and a source-side voltage for reverse power flow, a standard turns ratio between the primary winding and the secondary winding;

a tap changer;

a microprocessor producing a control signal operating the tap changer to regulate the system voltage to a desired value, for forward power flow the control signal responsive to the analog PT voltage, for reverse power flow the control signal responsive to the analog PT voltage and to a tap changer position; and the microprocessor simulating operation of a potential transformer connected between the source-side bushings and producing a simulated digital PT value responsive to the analog PT voltage and the tap changer position, the simulated digital PT value representing a source-side voltage for forward power flow and a load-side voltage for reverse power flow.

23. The voltage regulator of claim 22 further comprising a first apparatus converting the simulated digital PT value to a simulated analog PT voltage;

conductors carrying at least one of the analog PT voltage and the simulated analog PT voltage to accessible terminals of the voltage regulator, the terminals for receiving a measuring device for measuring a voltage across the terminals, the analog PT voltage representing a load-side voltage for forward power flow and a source-side voltage for reverse power flow, and the simulated analog PT voltage representing a source-side voltage for forward power flow and a load-side voltage for reverse power flow.

24. The voltage regulator of claim 23 the first apparatus comprising one of a digital-to-analog converter, a pulse-width modulator and an R-2R resistor network.

25. The voltage regulator of claim 23 the first apparatus further comprising a step-up transformer for increasing a magnitude of the simulated analog PT voltage.

26. The voltage regulator of claim 23 wherein the measuring device comprises a voltmeter or a multimeter.

* * * * *